US009441633B2

(12) United States Patent
Sheth et al.

(10) Patent No.: US 9,441,633 B2
(45) Date of Patent: Sep. 13, 2016

(54) DETECTION OF WELL FLUID CONTAMINATION IN SEALED FLUIDS OF WELL PUMP ASSEMBLIES

(71) Applicants: Ketankumar K. Sheth, Tulsa, OK (US); Suresha R. O'Bryan, Cypress, TX (US); Risa Rutter, Claremore, OK (US); Ryan A. Lack, Broken Arrow, OK (US); Sean A. Cain, Owasso, OK (US); Thomas N. Hendryx, Victoria, TX (US)

(72) Inventors: Ketankumar K. Sheth, Tulsa, OK (US); Suresha R. O'Bryan, Cypress, TX (US); Risa Rutter, Claremore, OK (US); Ryan A. Lack, Broken Arrow, OK (US); Sean A. Cain, Owasso, OK (US); Thomas N. Hendryx, Victoria, TX (US)

(73) Assignee: Baker Hughes Incorporated, Houston, TX (US)

( * ) Notice: Subject to any disclaimer, the term of this patent is extended or adjusted under 35 U.S.C. 154(b) by 197 days.

(21) Appl. No.: 14/044,462

(22) Filed: Oct. 2, 2013

(65) Prior Publication Data

US 2014/0099211 A1 Apr. 10, 2014

Related U.S. Application Data

(60) Provisional application No. 61/709,797, filed on Oct. 4, 2012.

(51) Int. Cl.
*F04D 15/02* (2006.01)
*F04D 13/10* (2006.01)
(Continued)

(52) U.S. Cl.
CPC ..... *F04D 15/0263* (2013.01); *E21B 43/126* (2013.01); *E21B 47/0007* (2013.01); *F04D 13/086* (2013.01); *F04D 13/10* (2013.01); *F04D 13/12* (2013.01); *F04D 15/02* (2013.01)

(58) Field of Classification Search
CPC .... F04D 13/06; F04D 13/0653; F04D 13/08; F04D 13/086; F04D 13/10; F04D 13/0686; F04D 13/12; F04D 13/14; F04D 13/16; F04D 15/02; F04D 15/0072; F04D 15/0245; F04D 15/0263; F04D 15/0281; F04D 15/029; F04D 15/005; F04D 29/061; F04D 29/08; F04D 29/086; F04D 29/10; F04D 29/106; F04D 29/108; F04D 29/14; F04D 29/146; E21B 43/126; E21B 47/0007; E21B 33/305; E21B 33/043; E21B 33/064; E21B 33/076; G01M 3/04; G01M 3/16; G01M 3/26
USPC ..... 417/12, 36; 73/1.31, 54.01, 54.02, 73/61.73; 340/605, 619, 856.3; 166/337
See application file for complete search history.

(56) References Cited

U.S. PATENT DOCUMENTS 4,013,953 A 3/1977 Skala
4,306,525 A 12/1981 Faxvog
(Continued)

FOREIGN PATENT DOCUMENTS

WO WO 2007/003445 A1 1/2007

OTHER PUBLICATIONS

Author: Luis et al. Title: Electrical Submersible Pumps for Geothermal Applications Date published(yyyy): 2010 Date Accessed(mm/dd/yyyy): Jul. 6, 2015 Link: http://www.slb.com/~/media/Files/technical_papers/2010/2010_esp_geothermal_applications.pdf.*
(Continued)

*Primary Examiner* — Devon Kramer
*Assistant Examiner* — Chirag Jariwala
(74) *Attorney, Agent, or Firm* — Bracewell LLP

(57) ABSTRACT

A submersible well pump assembly include a rotary pump driven by an electrical motor. A seal section operably connects between the motor and the pump for reducing a pressure differential between motor oil in the motor and well fluid surrounding the pump assembly. The pump assembly contains a sealed fluid. A sensor mounted to the well pump assembly detects contamination of the sealed fluid by well fluid encroaching into contact with the sealed fluid. The sensor may be mounted in the motor or the seal section to detect well fluid contamination of motor oil. The sensor may be mounted in a secondary pump that has that has temporary barriers to block the entry of well fluid into a buffer fluid contained in the secondary pump while the secondary pump is in a storage condition within a well.

13 Claims, 5 Drawing Sheets

(51) Int. Cl.

| | |
|---|---|
| ***F04D 13/08*** | (2006.01) |
| ***F04D 13/12*** | (2006.01) |
| ***E21B 43/12*** | (2006.01) |
| ***E21B 47/00*** | (2012.01) |

(56) References Cited

U.S. PATENT DOCUMENTS

| | | | | |
|---|---|---|---|---|
| 7,048,057 | B2 * | 5/2006 | Bearden et al. | 166/313 |
| 7,431,093 | B2 | 10/2008 | Bearden et al. | |
| 7,530,392 | B2 | 5/2009 | Sugiyama et al. | |
| 7,979,240 | B2 * | 7/2011 | Fielder | 702/185 |
| 8,347,953 | B1 * | 1/2013 | Elizondo et al. | 166/68 |
| 2009/0041597 | A1 * | 2/2009 | Brunner et al. | 417/410.1 |
| 2010/0000728 | A1 | 1/2010 | O'Keefe et al. | |
| 2010/0154529 | A1 | 6/2010 | Terabayashi et al. | |
| 2011/0005745 | A1 | 1/2011 | Goodwin | |
| 2011/0073316 | A1 | 3/2011 | DeCamargo | |
| 2011/0198076 | A1 | 8/2011 | Villreal et al. | |
| 2011/0297391 | A1 | 12/2011 | Fielder et al. | |
| 2013/0272898 | A1 * | 10/2013 | Toh | F04D 15/00 417/44.1 |
| 2014/0110124 | A1 * | 4/2014 | Goldner | E21B 47/1025 166/337 |

OTHER PUBLICATIONS

Paper entitled: "Development of a Low Cost Water Contamination Sensor Using Absorption Spectroscopy", by Angela J. Mason of Austin Peay State University, Clarksville, TN and Fluid Power Institute of Milwaukee, Wisconsin and Dr. William Carnell, Faculty Advisor.

Sandia Report entitled: "Review of Chemical Sensors for In-Situ Monitoring of Volatile Contaminants", by Clifford K. Ho, Michael T. Itamura, Michael Kelley and Robert C. Hughes.

Report Documentation Page entitled: "Capabilities and Limitations of a Cone Penetrometer Deployed Fiber Optic Laser Induced Fluorescence (LIF) Petroleum Oil and Lubricant (POL) Sensor" by William C. McGinnis, Michele Davey, of Computer Sciences Corporation and Karina D. Wu of San Diego State University Foundation and Stephen H. Lieberman of Research Development Test and Evaluation Division, San Diego, CA.

Paper entitled: "Overview of Fiber Optic Sensors" and References for Overview.

* cited by examiner

DETECTION OF WELL FLUID CONTAMINATION IN SEALED FLUIDS OF WELL PUMP ASSEMBLIES

CROSS-REFERENCE TO RELATED APPLICATION

This application claims priority to provisional application 61/709,797, filed Oct. 4, 2012.

FIELD OF THE DISCLOSURE

This invention relates in general to electrical submersible well pump assemblies containing sealed fluids and in particular to sensors for detecting well fluid contamination in the sealed fluids.

BACKGROUND

Electrical submersible pump assemblies are commonly used in hydrocarbon producing wells to pump well fluid. These assemblies include a rotary pump driven by an electrical motor. A seal section coupled between the pump and motor reduces a pressure differential between well fluid and motor oil or lubricant contained in the motor and part of the seal section. Usually, a string of production tubing supports the submersible pump assembly in the well. A chive shaft extends from the motor through the seal section to the pump. At least one shaft seal seals around the shaft to block the entry of well fluid into the motor and seal section. The well fluid often contains a high percentage of water, which is damaging to internal component so the motor.

Shaft seals are known to leak eventually, thus many submersible pump assemblies fail due to the entry of well fluid into the motor. The failure could be within a few months or years after installation. When a failure occurs, the operator has to retrieve the pump assembly for replacement or repair. Retrieval of a pump assembly suspended on production tubing requires pulling the production tubing, an expensive and time consuming task. Often, the operator will not know whether the failure resulted from encroaching well fluid into the motor or for some other reason.

One solution to reducing the cost of replacing a submersible pump assembly is to suspend two pump assemblies on a Y-tool secured into the production tubing. Each pump assembly has a rotary pump, seal section, and motor. One of the pump assemblies becomes the primary pump assembly, and it is operated initially. The secondary pump assembly will not be operated until the first pump assembly fails. A valve and an intake plug block well fluid from entering the secondary pump until needed, because the well fluid can be corrosive. The secondary pump would be filled with a non corrosive buffer fluid. At startup, the valve opens and the plug is dissolved or discharged to expel the buffer fluid and allow the well fluid to enter the secondary pump.

Also, the secondary pump could be a different type and/or one that produces more efficiently at a lower flow rate than the primary pump. The secondary pump would be employed possibly before the primary pump fails, but when lower well fluid flow into the well justifies using the secondary pump and shutting down the primary pump.

A problem with installing a secondary, non operating pump would occur if the well fluid began leaking into contact with the buffer fluid. By the time the operator wants to start the secondary pump, corrosive well fluid could have entered the secondary pump and damaged the components.

SUMMARY

A well pump assembly has a rotary pump and an electrical motor operably connected to the pump. A seal section connects between the motor and the pump for reducing a pressure differential between motor oil in the motor and well fluid in the well. A sealed fluid is contained in the well pump assembly. At least one sensor is mounted to the well pump assembly to detect contamination of the sealed fluid by well fluid encroaching into contact with the sealed fluid.

In one embodiment, at least one sensor is mounted in the motor, and the sealed fluid comprises motor oil located in the motor and in the seal section. One of the sensors may also be mounted in the seal section in contact with motor oil located within the seal section.

The seal section comprises a housing having a chamber with a well fluid entry port. A flexible element may be located in the chamber, having a motor oil side in fluid communication with the motor oil and a well fluid side for contact with and sealing the well fluid in the chamber from the motor oil. At least one of the sensors may be located in the chamber on the well fluid side of the flexible element. Further, the seal section may have a labyrinth chamber. At least one of the sensor may be located in the labyrinth chamber.

The installation may include a first sensor and a second sensor mounted to the submersible well pump assembly at an axial distance from the first sensor. The system may include an instrument panel that receives signals from the first and second sensors and identifies a delay between receiving signals indicating a presence of well fluid encroachment into the sealed fluid from the first sensor and from the second sensor.

The installation may include a primary well pump assembly and a secondary well pump assembly, the secondary well pump assembly adapted to be suspended in the well along with the primary well pump assembly, but initially in a non operating mode. The secondary well pump assembly has a barrier to prevent entry of well fluid into the pump during the non operating mode. The sealed fluid comprises a buffer fluid located in the pump of the secondary well pump assembly while in the non operating mode. At least one of the sensors is mounted in the pump of the secondary well pump assembly to monitor the buffer fluid.

One type of sensor may have a light source and a photo detector mounted opposite the light source. The light source emits a light beam that passes through part of the sealed fluid. A circuit determines attenuation of the light beam, which is indicative of the presence of well fluid in the sealed fluid.

DETAILED DESCRIPTION OF THE DISCLOSURE

Figure 1:
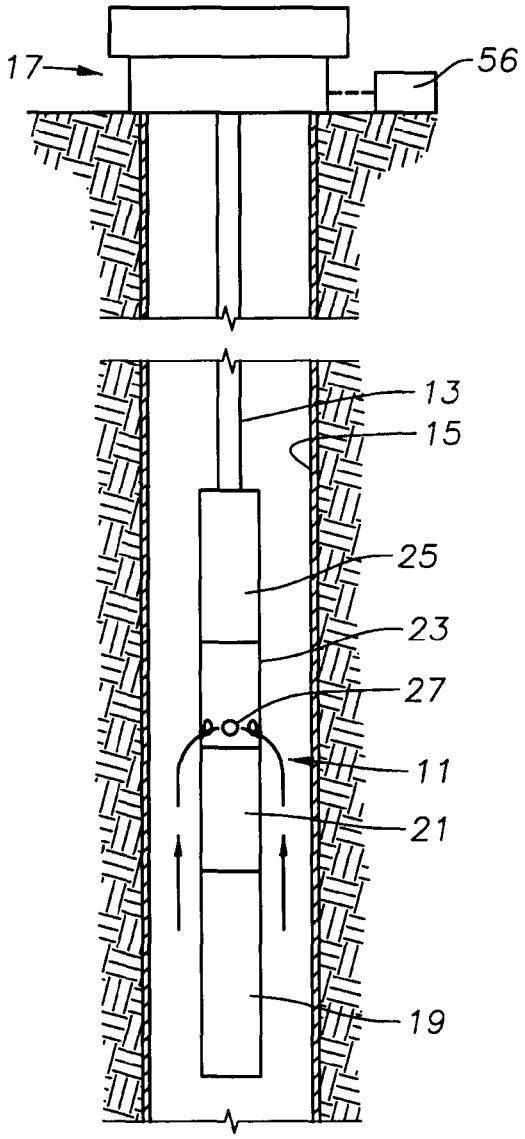
FIG. 1 is a schematic sectional view of an electrical submersible well pump assembly having a sensor for detecting well fluid contamination in sealed motor oil and shown suspended in a well.

Referring to FIG. 1, a well pump assembly 11 is suspended on production tubing 13 in a cased well 15 having a wellhead 17. Well pump assembly 11 has an electrical motor 19 connected to a seal section 21. An optional gas separator 23 is mounted on top of seal section 21, and a rotary pump 25 on top of gas separator 23. If gas separator 23 is employed, intake 27 for pump 25 is located in a lower portion of gas separator 23; otherwise, intake 27 would be in a lower end of pump 25. Pump 25 may be a centrifugal pump having a number of stages, each stage having an impeller and diffuser. Alternately, pump 25 could be another type of rotary pump, such as a progressing cavity pump, which has a helical rotor rotated within a double helical stator of an elastomeric material.

Figure 2:
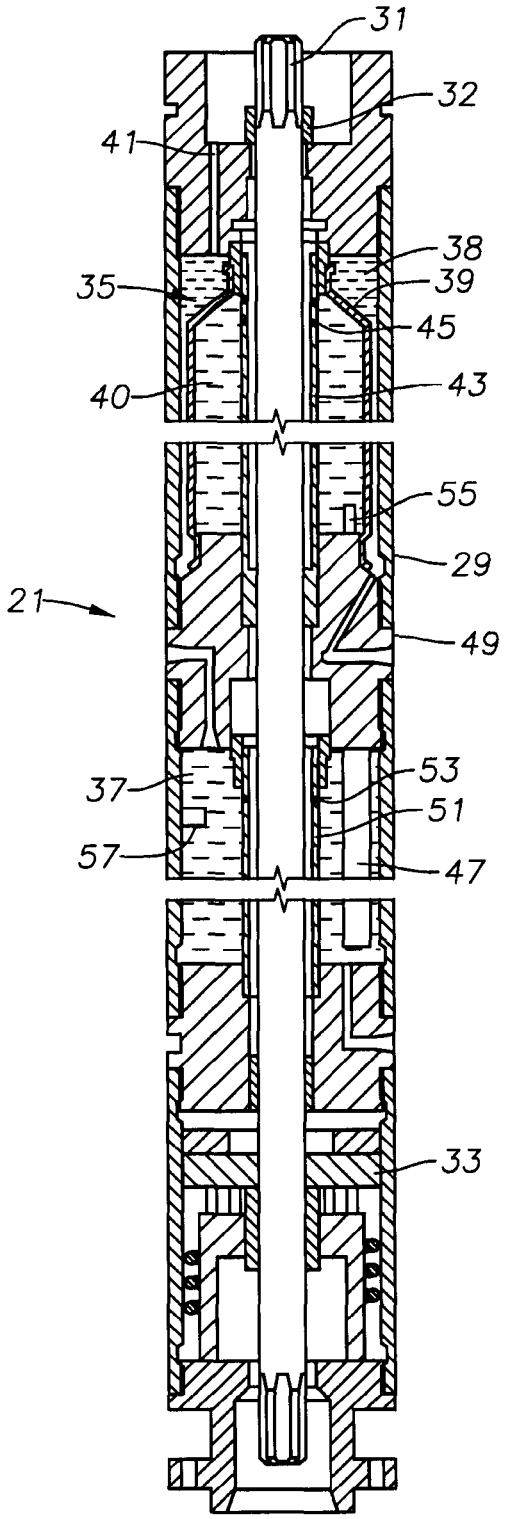
FIG. 2 is a sectional view of a seal section for the well pump assembly of FIG. 1.

Seal section 21 may be a variety of types, and in FIG. 2, it is shown as having a housing 29 through which a shaft 31 driven by motor 19 (FIG. 1) extends. An upper mechanical seal 32 seals around shaft 31 to retard the entry of well fluid. A thrust bearing 33 may be located in a lower portion of seal section 21. Seal section 21 is illustrated as having a bag or bellows chamber 35 located above a labyrinth chamber 37. Alternately, seal section 21 could comprise only one or more bag or bellows chambers 35 or one or more labyrinth chambers 37.

Bag chamber 35 includes an elastomeric bag 39. Alternately, bag 39 could be a bellows having a corrugated side wall formed of metal. Bag 39 separates well fluid 38 from motor oil 40 and expands and contracts to reduce a pressure differential between motor oil 40 contained in motor 19 (FIG. 1) and the hydrostatic pressure of well fluid 38. In the illustration shown, well fluid 38 is located on the exterior of bag 39 and motor oil 40 within, but this arrangement could be reversed. The well fluid in bag chamber 35 enters through a port 41 that is in fluid communication with the well fluid entering intake 27 (FIG. 1). A guide tube 43 within bag 39 surrounds shaft 31 and has ports 45 near an upper end of guide tube 43 to communicate motor oil 40 in guide tube 43 with the interior of bag 39.

One or more labyrinth tubes 47 are located in labyrinth chamber 37 to define a serpentine flow path for any well fluid 38 migrating through motor oil 40 toward motor 19. The labyrinth tube 47 shown has an upper end that attaches to a passage (not shown) leading from the interior of bag chamber guide tube 43. The lower end of labyrinth tube 47 is spaced a short distance above a lower end of labyrinth chamber 37. A mechanical seal 49 separates labyrinth chamber 37 from interior of bag 39, preventing motor oil 40 within guide tube 43 from flowing directly into a guide tube 51 in labyrinth chamber 37. Guide tube 51 has ports 53 near its upper end and surrounds shaft 31. Motor oil 40 contained in labyrinth chamber 37 is in fluid communication with the motor oil in motor 19 via guide tube ports 53 and the interior of guide tube 51.

Prior to installing pump assembly 11 in cased well 15, motor oil 40 is pumped into a lower end of motor 19, filling motor 19, guide tube 51, labyrinth chamber 37, guide tube 43, and the interior of bag 39. When lowered into well 15, well fluid 38 enters port 41 and applies hydrostatic pressure to motor oil 40 via the contraction of bag 39. That increase in pressure is applied to motor oil 40 in labyrinth chamber 37 and in motor 19. When motor 19 is energized, it generates heat, which causes motor oil 40 to expand in volume. The volume increase causes bag 39 to expand. When motor 19 is turned off, motor oil 40 cools and decreases in volume, causing bag 39 to contract. Motor oil 40 may be considered to be a sealed fluid isolated from well fluid 38. However, over time, well fluid 38 may enter into contact with motor oil 40 through leakage of mechanical seals 32, 49 and bag 39. Well fluid 38 is principally water, which is heavier than motor oil. The higher density retards well fluid 38 from flowing upward in bag 39 through guide tube port 45 and down guide tube 43 to labyrinth tube 47. The higher density also retards any water that may enter labyrinth chamber 37 from flowing upward to ports 53 and down the annular passages in guide tubes 51 toward motor 19. Nevertheless, well fluid can migrate downward, particularly in wells that are inclined.

At least one sensor 55 is mounted in seal section 21 to detect the contamination of motor oil 40 with well fluid 38. Preferably, sensor 55 is in a location to give an earliest indication of well fluid 38 entry into contact with motor oil 40. In the drawing of FIG. 2, sensor 55 is located in the interior and lower end of bag 39. Sensor 55 is connected by wires or optical fibers (not shown) leading to an instrument panel 56 at or adjacent wellhead 17 (FIG. 1) to provide an operator with information of the well fluid content in motor oil 40. Instrument panel 56 may also be a controller for operation of motor 19. Sensor 55 or another sensor may also provide information concerning the quantity of particles that may have entered motor oil 45. A second sensor 57 is shown mounted in labyrinth chamber 37 adjacent guide tube port 53. Second sensor 57 is axially spaced below first sensor 55 relative to a longitudinal axis of well pump assembly 11.

First sensor 55 would normally provide an indication of well fluid encroachment into motor oil 40 before second sensor 57 because of the closer proximity of first sensor 55 to upper mechanical seal 32. Instrument panel 56 may have a microprocessor or other circuitry to record a time that elapses between receiving a well fluid encroachment signal from first sensor 55 and from second sensor 57. The time delay would be indicative of how fast well fluid is leaking into seal section 21. Instrument panel 56 could be programmed to provide an estimate to an operator of the amount of time before retrieving well pump assembly 11 for repair or replacement should occur.

Sensors 55, 57 may be an opacity sensor, fluid density sensor, conductivity sensor, ph sensor, absorption spectroscopy sensor, an opacity sensor, a fluorescent fiber sensor, a fiber optic sensor, or any other sensor suitable for differentiating between motor oil 40 and well fluid 38. Sensors 55, 57 may be electronically powered or receive light from fiber optic lines leading to instrument panel 56, and may be of known types. As another example, one suitable fiber optic sensor operates on a principle of total internal reflection. Light propagated down the fiber core hits angled end of the fiber. Light is reflected based on the index of refraction of the sealed fluid into which the angled end of the fiber is placed. The index of refraction varies in response to whether it contains water within the sealed liquid.

Another type of fiber optic sensor employs fluorescent material on the probe. The fluorescent signal is captured by the same fiber and directed back to an output demodulator. The returning signal can be proportional to viscosity and water droplet content. The well fluid normally would have a different viscosity that the sealed fluid being monitored, thus a measurement of viscosity correlates to well fluid encroachment in the sealed liquid.

A variety of telemetry techniques are known for communicating sensed parameters of well pump assemblies, such as pressure and temperature. These techniques include superimposing a sensor signal onto the power cable leading to the motor, or sing a separate instrument wire or fiber optic line leading to instrument panel 56. These techniques may be used for transmitting signals from sensors 55, 57.

Figure 3A:
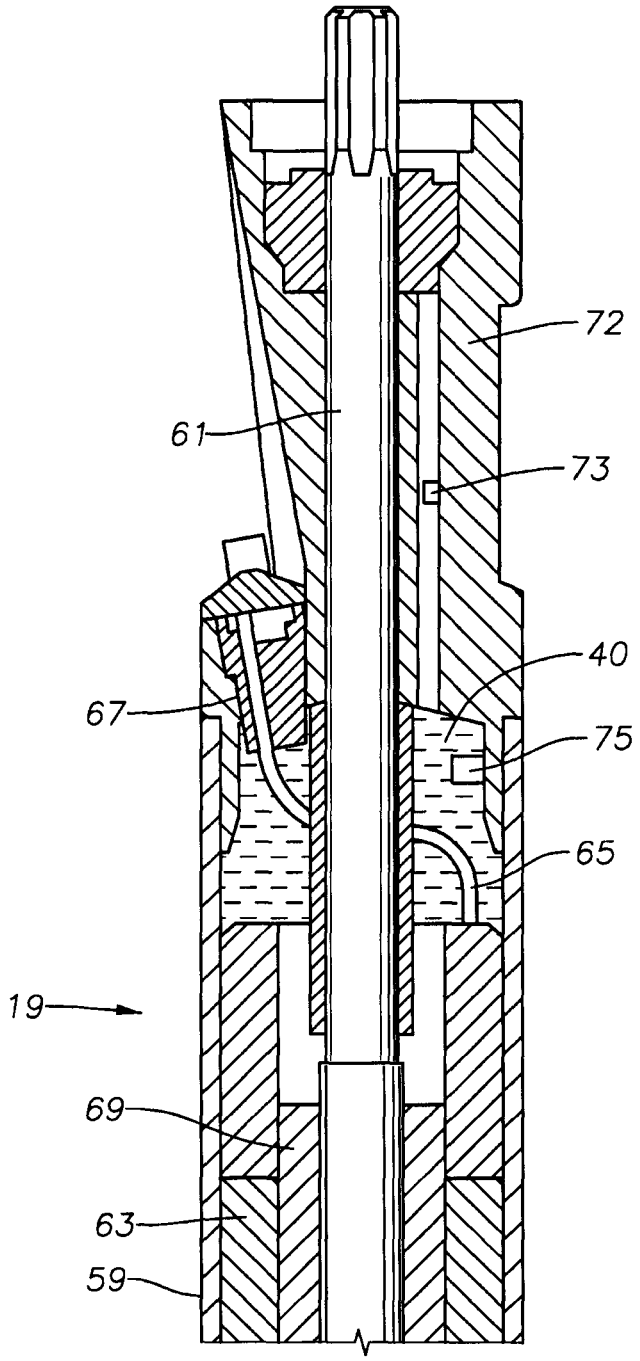
FIGS. 3A and 3B comprise a sectional view of the motor of the well pump assembly of FIG. 1.
Figure 3B:
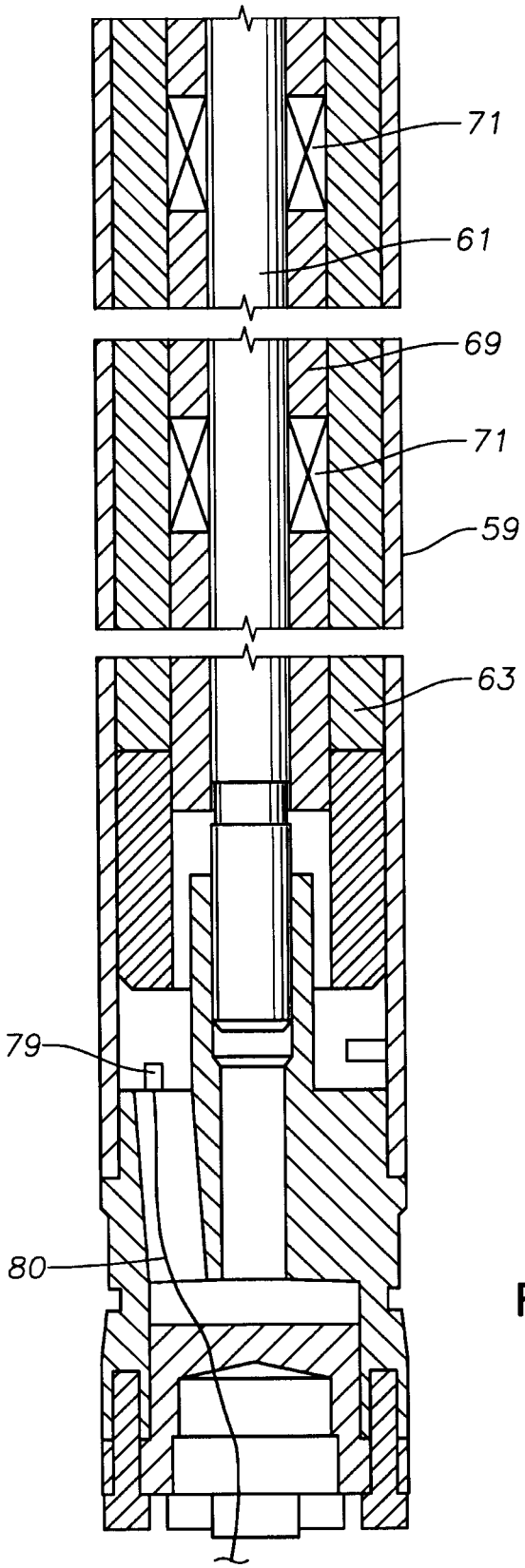

Referring to FIGS. 3A and 3B, motor 19 has a housing 59 and a driven shaft 61. A stator 63 containing windings in laminated disks is mounted in housing 59. Motor leads 65 for the three phases extend to a pothead connector 67 for connection to a power cable (not shown). Rotor sections 69 are mounted to shaft 61 and supported radially by bearings 71. An adapter or motor head 72 forms the upper end of motor 19 and secures to seal section 21 (FIG. 2). Motor 19 will be filled with motor oil 40. A sensor 73 is mounted to the interior of housing 59 within motor head 72 for providing an early warning of encroaching well fluid 38 (FIG. 2). Alternately or in addition, a sensor 75 may be in the upper end of housing 59 near motor leads 67. In addition, a sensor 79 may be located in housing 59 below stator 59. Although not in a location for early detection of well fluid entry, sensor 79 has an advantage of being readily connected by a wire 80 to an instrument sub (not shown) often mounted to the lower end of motor 19. The instrument sub normally contains pressure and temperature sensors and may be connected into the windings of stator 63 for power and data transmission. Sensors 73, 75 and 79 may be the same type as sensors 55, 57 in seal section 21 (FIG. 2). Sensors 73, 75 and 79 are also in communication with instrument panel 56, which may record time differences between receipt of well fluid detection signals of these sensors, as well.

Figure 4:
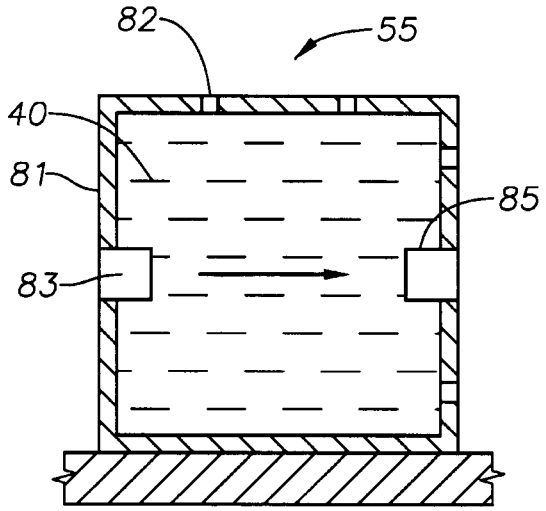
FIG. 4 is an schematic sectional view of a motor oil contamination sensor employed with the well pump assembly of FIG. 1.

FIG. 4 illustrates one type of sensor 55 suitable for detecting encroaching water or well fluid 38 into motor oil 40. Sensor 55 has a housing 81 with perforations 82 for the entry of motor oil 40 and any well fluid 38 that may be present. In this type of sensor, a light source or laser 83 directs a light or laser beam through motor oil 40 within housing 81 to a photo detector 85. Circuitry associated with sensor 55 relies on a principle of absorption spectroscopy, which is the absorption of photons by one or more substances present in a sample. At certain wavelengths, water has a very strong absorption while motor oil has minimal absorption. For example, the absorption of a light beam through water is much higher at about 1470 and 1900 nm (nanometers) than at other wavelengths. Light source 83 thus emits a beam with a wavelength of about 1470 nm, for example. Photo detector 85 reads out the power of the light beam received to determine the absorption or attenuation of the light beam within the motor oil 40. If water is present, the light beam will be attenuated much more so than if the light beam passes only through motor oil 40. Detecting particles contaminating the motor oil, if desired, may require an additional sensor, such as another one passing light through the sample and detecting the attenuation of the light beam.

Figure 5:
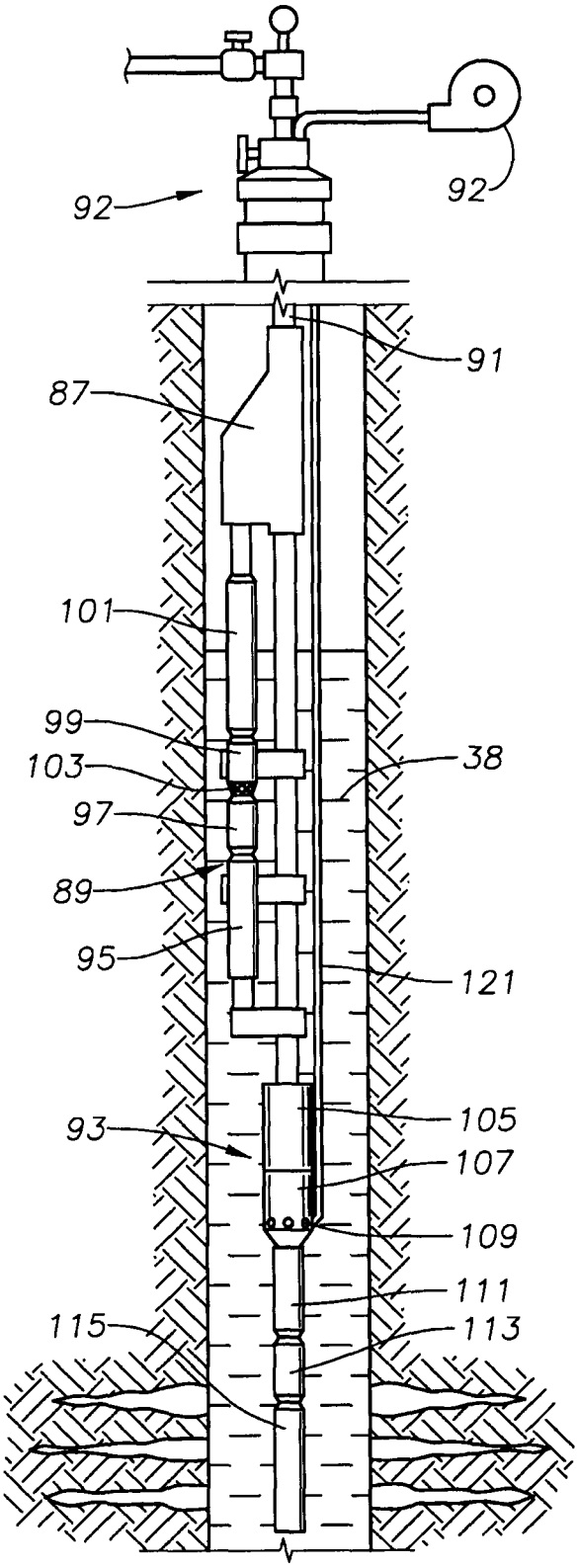
FIG. 5 is a sectional view of a primary and a backup electrical submersible pump assembly installed within a well, the backup pump assembly being filled with a buffer fluid prior to use and containing a sensor for detecting well fluid contamination the buffer fluid.

FIG. 5 illustrates an embodiment of a well pump assembly employing a sensor for detecting encroaching well fluid into a sealed liquid within the assembly. As described in more detail in U.S. Pat. No. 7,431,093, a Y-connector 87 supports an upper or primary well pump assembly 89. Y-connector 87 is supported on tubing 91 extending downward from a wellhead 92. Tubing 91 also extends alongside primary well pump assembly 89 to a lower or secondary well pump assembly 93. Alternately, secondary well pump assembly 93 could be considered to be the primary pump assembly and primary pump assembly 89 the secondary. Y-connector 87 has a valve or closure member (not shown) that selectively allows well pump assemblies 89, 93 to produce well fluid to wellhead 92 alone or together.

Primary well pump assembly 89 has an electrical motor 95 connected to a seal section 97, which in turn connects to an optional gas separator 99. A pump 101, which in this example, is a centrifugal pump, connects to the upper end of gas separator 99; if one is employed. Intake 103 is located at the base of gas separator 99; or if not employed, intake 103 will be at the base of pump 101.

Secondary pump assembly 93 is illustrated as being a progressive cavity type, rather than centrifugal, but it could be centrifugal. Secondary pump assembly 93 has a progressive cavity pump 105, which has a helical rotor rotated in a double helical elastomeric stator (not shown). The rotor orbits and connects to a flex shaft section 107 that accommodates the orbital movement at an upper end and has an axially restrained rotational bearing at its lower end. Intake ports 109 are located in flex shaft section 107. A seal section 111 of a type similar to seal section 97 connects to the lower end of flex shaft section 17. Because a progressive cavity pumps rotates much slower than a centrifugal pump, a gear reducer 113 is connected between the shaft portion in flex shaft section 107 and an electrical motor 115.

Figure 6:
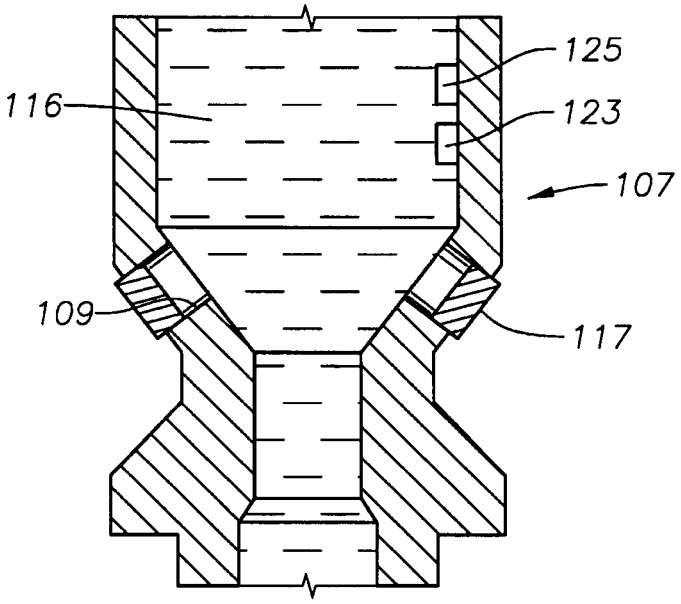
FIG. 6 is an enlarged view of the intake of the backup pump assembly of FIG. 5.

Secondary pump assembly 93 is initially in an off or non operating mode with no power being supplied to motor 115 while power is being supplied to motor 95 of primary pump assembly 89. At a later date, secondary pump assembly 93 will be turned on, and primary pump assembly 89 optionally may be turned off. That date could occur when primary pump assembly 89 fails, thus could be months or even years later. If intake 109 is open, well fluid 38 would completely fill pump 105 and portions of seal section 111. To avoid deterioration of the internal components due to the immersion in well fluid 38, pump 105 and the well fluid part of seal section 111 are filled with a protective buffer fluid 116, as shown in FIG. 6. For simplification, the drive shaft is not shown within flex shaft section 107 in FIG. 6. Buffer fluid 116 may have a lessor or a greater specific gravity than well fluid 38. For example, buffer fluid 116 could be a hydrocarbon-based liquid such as diesel fuel.

Temporary plugs 117 are placed in intake ports 109 to separate buffer fluid 116 from external well fluid. The discharge of pump 105 may be sealed by the valve or another plug in Y-connector 87. To retard leakage, buffer fluid 116 is kept at approximately the same hydrostatic pressure as well fluid 38. Maintaining the pressure may be performed by a surface pump 119 (FIG. 5) that has an intake connected to a reservoir (not shown) of buffer fluid 116 and an outlet leading through a buffer fluid line 121 leading to flex shaft section 107. Line 121 may have two passages, with one leading to an upper end of secondary pump 105 to enable surface pump 119 to circulate buffer fluid 116 through and back from secondary pump 105.

A well fluid sensor 123 is mounted within a portion of secondary pump assembly 93 containing buffer fluid 116. Well fluid sensor 123 is illustrated as being mounted within flex shaft section 107 adjacent intake ports 109. If buffer fluid 116 had a lighter specific gravity than well fluid 38, well fluid sensor 123 may be mounted at an upper end of secondary pump 105. Well fluid sensor 123 will be connected to wires or fiber optic lines for conveying a signal to a surface panel at wellhead 92. Well fluid sensor 123 may be a same type as sensors 55, 57, 73, 75 and 79 for detecting well fluid, principally water, in buffer fluid 116. An optional pressure sensor 125 provides a signal to the surface panel of the pressure of buffer fluid 116. Sensors for detecting well fluid contamination in the motor oil of primary and secondary pump assemblies 89, 93 may also be used.

While primary pump assembly 89 is operating and secondary pump assembly 93 turned off, plugs 117 will seal buffer fluid 116 in secondary pump 105. Well fluid sensor 123 provides signals indicating whether or not any well fluid 38 has contaminated buffer fluid 116. If well fluid 38 is detected, the operator may choose to circulate uncontaminated buffer fluid 116 into pump 105 with surface pump 119. Alternately, the operator may choose to place secondary pump 105 in immediate operation by removing plugs 117 and turning on surface pump 105. The operator may remove plugs 117 at any time by increasing pressure of buffer fluid 116 with surface pump 119. Plugs 117 could alternately be of a type soluble in a solvent that the operator pumps down lines 121.

While the invention has been shown in only a few of its forms, it should be apparent to those skilled in the art that it is not so limited but is susceptible to various changes without departing from the scope of the disclosure.

The invention claimed is:

1. An apparatus for pumping well fluid from a well, comprising:

at least one submersible well pump assembly for lowering into the well to pump well fluid, the at least one submersible well pump assembly comprising:

a rotary pump;

an electrical motor operably connected to the pump;

a sealed fluid contained in the well pump assembly;

a seal section operably connected between the motor and the pump for reducing a pressure differential the sealed fluid contained in the motor and the well fluid in the well;

at least one sensor mounted to the well pump assembly that detects contamination of the sealed fluid by the well fluid encroaching into contact with the sealed fluid;

a well fluid contamination first sensor mounted to the submersible well pump assembly and a well fluid contamination second sensor mounted to the submersible well pump assembly at an axial distance from the first sensor, relative to a longitudinal axis of the submersible well pump assembly, each of the first and second sensors being of a type that will detect a presence of well fluid encroachment into the sealed fluid; and means for receiving signals from the first and second sensors indicating a presence of well fluid encroachment into the sealed fluid and for determining a time delay between a well fluid presence signal received by the first sensor and a well fluid presence signal received by the second sensor to estimate how fast well fluid is leaking into the sealed fluid.

2. The apparatus according to claim 1, wherein:

the first and second sensors are mounted in the motor; and the sealed fluid comprises motor oil located in the motor and in the seal section.

3. The apparatus according to claim 1, wherein:

the first and second sensors are mounted in the seal section; and the sealed fluid comprises motor oil located within the seal section.

4. The apparatus according to claim 1, wherein the at least one submersible well pump assembly comprises:

a primary well pump assembly and a secondary well pump assembly, the secondary well pump assembly adapted to be suspended in the well along with the primary well pump assembly, but initially in a non operating mode;

the secondary well pump assembly having a barrier to prevent entry of well fluid into the rotary pump during the non operating mode;

the sealed fluid comprises a buffer fluid located in the rotary pump of the secondary well pump assembly while in the non operating mode; and at least one of the first and second sensors is mounted in the buffer fluid in the pump of the secondary well pump assembly.

5. The apparatus according to claim 1, wherein each of the first and second sensors comprises:

a light source;

a photo detector mounted opposite the light source for receiving a light beam emitted by the light source, the light source and the photo detector being mounted so as to pass the light beam through the sealed fluid; and a circuit configured to determine attenuation of the light beam.

6. The apparatus according to claim 1, wherein the seal section comprises:

a housing having a chamber with a well fluid entry port;

a flexible element located in the chamber having an interior filled with the sealed fluid in fluid communication with the sealed fluid in the motor and an exterior for contact with the well fluid in the chamber; and wherein the first sensor is located in the interior of the flexible element.

7. The apparatus according to claim 6, wherein:

the seal section has a labyrinth chamber; and the second sensor is located in the labyrinth chamber.

8. An apparatus for pumping well fluid from a well, comprising:

a primary submersible well pump assembly and a secondary submersible well pump assembly for lowering as an unit into the well, the secondary submersible well pump assembly being initially in a non operating mode, the secondary submersible well pump assembly comprising:

a rotary pump filled with a buffer fluid and having an intake initially closed with a barrier to prevent entry of well fluid into the buffer fluid;

well fluid contamination upper and lower sensors mounted in the rotary pump within the buffer fluid, the upper sensor being mounted above the lower sensor, each of the sensors being configured to sense well fluid leaking into the buffer fluid;

an instrument panel adapted to be mounted adjacent a wellhead and linked to the upper and lower sensors for receiving signals from the upper and lower sensors indicating sensing a presence of well fluid in the buffer fluid; and means in the instrument panel for determining a time delay between receiving a well fluid presence signal from the upper sensor and receiving a well fluid presence signal from the lower sensor so as to indicate how fast well fluid is leaking into the rotary pump.

9. The apparatus according to claim 8, further comprising a pressure sensor mounted in the buffer fluid in the rotary pump, the pressure sensor configured to sense a buffer fluid pressure.

10. The apparatus according to claim 8, wherein each of the upper and lower sensors comprises:

a light source that transmits a light beam along a path through the buffer fluid, the light beam having a wavelength selected that has a different absorption rate for well fluid than for the buffer fluid; and a photo detector that detects a strength of the light beam, the strength being indicative of well fluid encountered along the path.

11. A method of pumping well fluid from a well, comprising:

providing at least one submersible well pump assembly comprising a rotary pump, an electrical motor operably connected to the rotary pump, a seal section operably connected between the motor and the rotary pump, a longitudinal axis, and a sealed fluid contained in the at least one submersible well pump assembly;

mounting a well fluid contamination first sensor to the at least one submersible well pump assembly and a well fluid contamination second sensor to the at least one submersible well pump assembly at an axial distance from the first sensor;

lowering said at least one submersible well pump assembly into the well; and receiving signals from the first and second sensors indicating a presence of well fluid in the sealed fluid and determining a time delay between a well fluid presence signal received by the first sensor and a well fluid presence signal received by the second sensor to estimate how fast well fluid is leaking into the sealed fluid.

12. The method according to claim 11, wherein:

the sealed fluid comprises motor oil located in the motor and the seal section; and the first and second sensors are mounted in the motor oil.

13. The method according to claim 11, wherein:

providing the at least one submersible well pump assembly comprises:

providing a primary well pump assembly and a secondary well pump assembly, the secondary well pump assembly having a barrier to prevent entry of well fluid into the rotary pump during the non operating mode, and the sealed fluid comprises a buffer fluid located in the rotary pump of the secondary well pump assembly;

lowering the at least one submersible well pump assembly comprises:

simultaneously lowering both the primary well pump assembly and the secondary well pump assembly into the well along with the primary well pump assembly; and the method further comprises:

operating the primary well pump assembly and leaving the secondary well pump assembly non operating with the buffer fluid located therein; and detecting with the first and second sensors any encroachment of well fluid into contact with the buffer fluid.

* * * * *